US011534676B2

(12) United States Patent
Liebl

(10) Patent No.: US 11,534,676 B2
(45) Date of Patent: Dec. 27, 2022

(54) CUE WITH KINETIC ENERGY ABSORBING INSERT

(71) Applicant: McDermott Cue Mfg., LLC, Menomonee Falls, WI (US)

(72) Inventor: Larry Liebl, Cedarburg, WI (US)

(73) Assignee: McDermott Cue Mfg., LLC, Menomonee Falls, WI (US)

( * ) Notice: Subject to any disclaimer, the term of this patent is extended or adjusted under 35 U.S.C. 154(b) by 522 days.

(21) Appl. No.: 16/574,717

(22) Filed: Sep. 18, 2019

(65) Prior Publication Data

US 2021/0077896 A1 Mar. 18, 2021

(51) Int. Cl.
*A63D 15/12* (2006.01)

(52) U.S. Cl.
CPC ..... *A63D 15/12* (2013.01)

(58) Field of Classification Search
CPC ..... A63D 15/12; A63D 15/08; A63D 15/086; A63D 15/083; A63B 53/002; A63B 53/005; A63B 2243/002
USPC ..... 473/440
See application file for complete search history.

(56) References Cited

U.S. PATENT DOCUMENTS 1,705,353 A * 3/1929 Barrett ..... A63D 15/08 473/47
3,232,613 A 2/1966 Laube
3,372,932 A 3/1968 Molis
5,465,967 A 11/1995 Boeckenhaupt
6,939,237 B1 9/2005 Voden
7,431,655 B2 10/2008 McCarty et al.
8,876,618 B1 * 11/2014 Brown ..... A63D 15/08 473/44
2005/0043107 A1 2/2005 Kuo
2005/0079925 A1 4/2005 Cheng
2006/0264266 A1 11/2006 Jung
2007/0010340 A1 * 1/2007 Miki ..... A63D 15/08 473/44
2009/0111595 A1 4/2009 Owen
(Continued)

FOREIGN PATENT DOCUMENTS

CN 207493184 6/2018
CN 208145424 11/2018
(Continued)

OTHER PUBLICATIONS

European Search Report dated Feb. 10, 2021 cited in EP Patent Application No. 20196589.4.
(Continued)

*Primary Examiner* — John E Simms, Jr.
*Assistant Examiner* — Rayshun K Peng
(74) *Attorney, Agent, or Firm* — Andrus Intellectual Property Law, LLP

(57) ABSTRACT

A cue for billiard sports that has a butt section, a joint collar, and a shaft section that has a kinetic energy absorbing insert located in the shaft section of the cue. A shaft section that has a kinetic energy absorbing insert that may be connected to an existing joint collar and butt section of a cue to improve the kinetic energy absorbing characteristics of the cue. A kinetic energy absorbing insert that is to be received by an existing shaft section of a cue in order to increase the kinetic energy absorbing characteristics of the cue is also disclosed.

33 Claims, 3 Drawing Sheets

(56) References Cited

U.S. PATENT DOCUMENTS

2009/0111596 A1* 4/2009 Owen ..... A63D 15/08
473/44
2012/0190467 A1 7/2012 Liebl

FOREIGN PATENT DOCUMENTS

FR 688023 8/1930
WO WO-2015148289 A1 * 10/2015 ..... A63D 15/08

OTHER PUBLICATIONS

European Search Report dated May 4, 2020 cited in EP Patent Application No. 19215317.9.

* cited by examiner

CUE WITH KINETIC ENERGY ABSORBING INSERT

The present disclosure relates generally to cue sticks with a kinetic energy absorbing insert used in cue sports and billiard sports, including but not limited to carom billiards, pool, snooker, and English billiards.

BACKGROUND

There is a need in the art to create a cue stick or cue stick shaft that will absorb kinetic energy in the delivery of the cue shaft tip to the cue ball to improve cue ball control, and increase the energy transfer from a ball to a cue when the ball is struck. A main problem is that the shaft tip wants to bounce back off the ball which then causes the ball to deflect in an unwanted direction. When a cue is projected forward to make contact with the cue ball, the kinetic energy from a player's arm is transferred though the cue to the cue ball. When the cue collides with the cue ball at the cue tip, energy from the contact is transferred to the cue ball, but other forces dissipate into the shaft and outwardly from the shaft into the ambient air. Since the cue tip is rounded and the cue ball is spherical, if the cue tip makes less than precise contact between the center of the cue tip and the center of the cue ball, the cue ball can go off in an uncontrolled direction. The forces dissipating from the shaft at the point of contact are believed to exacerbate the loss of control for the player. Currently, players then use what is known as English to counteract this reaction, which means hitting the ball off center high or low forcing it to do what they desire. This makes the game much more difficult/challenging when learning this technique.

The present disclosure relates to a cue having a kinetic energy absorbing insert, also to a shaft section for a cue having a kinetic energy absorbing insert, and to a kinetic energy absorbing insert for insertion in a shaft section of a cue that improves ball control. The present invention increases ball control by reducing the consequences of a less than perfect strike between the cue tip and cue ball.

Prior art attempts have been entirely unsuccessful because the focus was on vibration dampening rather than kinetic energy absorption. U.S. Pat. No. 7,431,655 discloses a cue shaft with a bore, where the bore is partially or substantially filled with a non-structural material such as foam, cotton, etc. for vibration and/or sound dampening purposes without detracting from the weight reducing features of the tip end of the shaft. Applicant's experimentation with foam, cotton, and other non-structural materials found these to be ineffective in creating significant kinetic energy absorbing to improve cue ball control. Moreover, Applicant has discovered that weight reduction is not pertinent to increasing ball control, and that adding structural material in the nature of a kinetic energy absorbing insert, even if it adds weight, increases control over the cue ball with a shaft having such an insert. The present invention provides a significant kinetic energy absorbing effect such that the cue, when dropped, does not bounce off of the surface. The structural and kinetic energy absorbing properties inherent in this technology are a significant improvement over the prior art.

Accordingly, it is desirable to overcome the drawbacks of prior art cues and provide a cue that increases energy transfer from the ball to the cue when the ball is struck.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure relates to a cue having a butt section, a joint collar, and a tapered cylindrical shaft section. The aforesaid shaft section has a first end and a second end. The shaft has a longitudinal bore extending partially into or all the way through the shaft. In some embodiments the bore may extend partially into the shaft from the first (tip) end to a location spaced longitudinally from the first end. Alternatively, the bore may extend partially into the shaft from the second (joint) end to a location spaced longitudinally from the second end. In still other embodiments multiple bores starting from both the first end and the second end may be implemented. A ferrule is located at the shaft at the first end and a tip attached to the ferrule. The shaft section also has a joint insert located at the second end of the shaft to connect the shaft section to a joint collar and a butt section. The cue has a generally cylindrical kinetic energy absorbing insert with circumferential protrusions extending radially outwardly therefrom located in the bore of the shaft and contacting the shaft.

In certain embodiments, the kinetic energy absorbing insert has a generally cylindrical body with a diameter that is less than the bore diameter of the shaft. The cylindrical body of the kinetic energy absorbing insert may taper outwardly from the first end to the second end. In other embodiments, the kinetic energy absorbing insert is a material that fills part of or the entire bore in the shaft. In certain embodiments, the kinetic energy absorbing insert is constructed of a structural elastomeric material. In some embodiments, the structural elastomeric material is butyl rubber. In other embodiments the insert may be wrapped in an energy absorbing material. In still other embodiments the insert may be used in conjunction with energy absorbing paint. The kinetic energy absorbing insert may be disposed to approximately the middle of the shaft, equidistant between the first end and the second end of the shaft of the cue. Alternatively, the kinetic energy absorbing insert may be located adjacent the first end or the second end of the shaft.

The shaft section of the cue may also include at least one filler insert for maintaining the longitudinal position of the kinetic energy absorbing insert within the bore of the shaft. At least one filler insert may be disposed to the bore of the shaft between the ferrule and the first end of the kinetic energy absorbing insert. Another filler insert may be disposed in the bore of the shaft between the second end of the kinetic energy absorbing insert and the joint insert. In certain embodiments, the filler inserts are generally spherical. The shaft section of the cue of the present application may further include a viscoelastic dampening foam located in the bore of the shaft between the first end of the cylindrical body and the ferrule and also between the second end of the cylindrical body and the joint insert. In still other embodiments, a combination of viscoelastic dampening foam and dampening paint either alone or in conjunction with additional elastomeric material form the kinetic energy absorbing insert.

The shaft may be composed of carbon fiber material, aluminum, fiberglass, graphite, wood material, a hybrid of such material or another material. In certain embodiments the joint insert of the shaft section has an internally threaded surface for threadably connecting the shaft section to the butt section of the joint collar. In other embodiments the joint insert of the shaft section has a threaded pin extending from the second end of the shaft for threadably connecting the shaft section to the butt section of the joint collar.

The present disclosure is also directed to a shaft section for a cue used for cue sports. The shaft section tapers outwardly from the first end to the second end and has a bore extending from the first end to the second end. In some embodiments the bore may extend partially into the shaft from the first (tip) end to a location spaced longitudinally from the first end. Alternatively, the bore may extend partially into the shaft from the second (joint) end to a location spaced longitudinally from the second end. In still other embodiments multiple bores starting from both the first end and the second end may be implemented. The shaft section also has a ferrule located at the shaft first end with a tip attached to the ferrule. A joint insert for connecting the shaft section to a joint collar and a butt section of a cue is located at the second end of the shaft. The shaft section includes a generally cylindrical kinetic energy absorbing insert located in the bore of the shaft contacting the bore of the shaft. The kinetic energy absorbing insert has a length between a first end and a second end that is less than the length of the shaft. The diameter of the cylindrical body of the kinetic energy absorbing insert is less than the bore diameter. The kinetic energy absorbing insert includes a plurality of circumferential protrusions that extend radially outwardly from the cylindrical body. The protrusions have a diameter generally equal to or greater than the diameter of the bore of the shaft such that the protrusions contact the shaft along the bore through the shaft. In other embodiments, the kinetic energy absorbing insert is a material that fills part of or the entire bore in the shaft. In certain embodiments, the kinetic energy absorbing insert is constructed of a structural elastomeric material. In some embodiments, the structural elastomeric material is butyl rubber. In other embodiments the insert may be wrapped in an energy absorbing material. In still other embodiments the insert may be used in conjunction with energy absorbing paint. In still other embodiments, a combination of viscoelastic dampening foam and dampening paint either alone or in conjunction with additional elastomeric material form the kinetic energy absorbing insert. The kinetic energy absorbing insert may be disposed to approximately the middle of the shaft, equidistant between the first end and the second end of the shaft of the cue. Alternatively, the kinetic energy absorbing insert may be located adjacent the first end or the second end of the shaft.

The present disclosure is also directed to a kinetic energy absorbing insert for insertion into a bore of a shaft section of a cue. The kinetic energy absorbing insert has a generally cylindrical body that has a first end and a second end, with the length between the first end and the second end being less than length of a bore of a shaft section. The diameter of the cylindrical body is less than the diameter of the bore of the shaft section. The kinetic energy absorbing insert may have a bore extending from the first end of the cylindrical body to the second end of the cylindrical body. The kinetic energy absorbing insert also may have a plurality of circumferential protrusions extending radially outwardly from the cylindrical body. The insert has a protrusion located at the first end of the cylindrical body, a protrusion located at the second end of the cylindrical body, and a plurality of protrusions spaced equally there between. The diameter of the protrusions is equal to or greater than the diameter of the bore of the shaft section such that the protrusions contact the shaft section.

BRIEF DESCRIPTION OF THE DRAWINGS

The present disclosure is described with reference to the following Figures. The same numbers are used throughout the Figures to reference like features and like components.

The best mode of carrying out the invention is described herein below with reference to the following drawing figures.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed. The different methods and assemblies described herein may be used alone.

Figure 1:
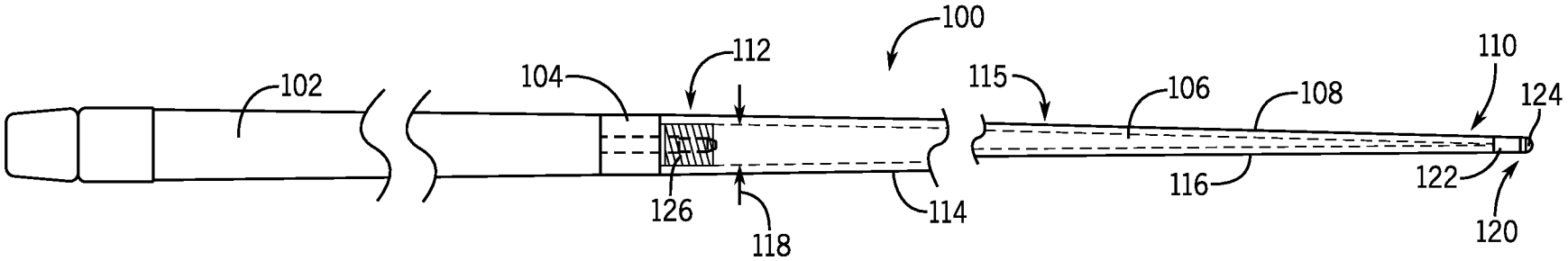
FIG. 1 is an exemplary drawing of a cue having a bore through a shaft section for receiving a kinetic energy absorbing insert in accordance with the present application.

Referring now to FIG. 1, a cue 100 having a butt section 102, a joint collar 104, and a shaft section 106 is shown. The butt section 102 or shaft 114 of the cue 100 may be made of a carbon fiber or wood material. The shaft section 106 has a tapered cylindrical shape 108 with a first end 110 and a second end 112. The shaft section 106 has a shaft 114 that has a longitudinal bore 116 extending through the shaft 114. In alternative embodiments, the bore 116 may extend partially into the shaft 114 from the first end 110 to a location spaced longitudinally from the first end 110 toward the second end 112. Alternatively, the bore 116 may extend partially into the shaft 114 from the second end 112 to a location spaced longitudinally from the second end 112 toward the first end 110. In still other embodiments multiple bores starting from both the first end and the second end may be implemented. The longitudinal bore 116 defines a bore diameter 118. The shaft section 106 also has a tip portion 120 located in the bore 116 of the shaft 114 at the first end 110 of the shaft 114. The tip portion 120 has a ferrule 122 and a tip 124. In one embodiment, the ferrule 122 may be a low-rebound or vibration-dampening ferrule; alternatively or simultaneously the tip 124 may be a low-rebound or vibration-dampening tip. The tip 124 is removably connected to the ferrule 122. One way to secure the tip 124 to the ferrule 122 is by adhesive, although other ways to attach the tip 124 to the ferrule 122 are possible and within the scope of the present application. The ferrule 122 may be secured in the shaft 114 by press-fit, adhesive, a combination of the two, or by other known ways to secure a ferrule 122 in a bore 116 of a shaft section 106. The shaft section 106 also has a joint insert 126 located at the second end 112 of the shaft 114 for connecting the shaft section 106 to the joint collar 104 and to the butt section 102. The joint insert 126 is secured in the shaft 114 by threaded connection, press-fit, adhesive, a combination of these, or other known means. In one example, the joint insert 126 could be a low-rebound or kinetic energy absorbing joint insert.

Figure 2:
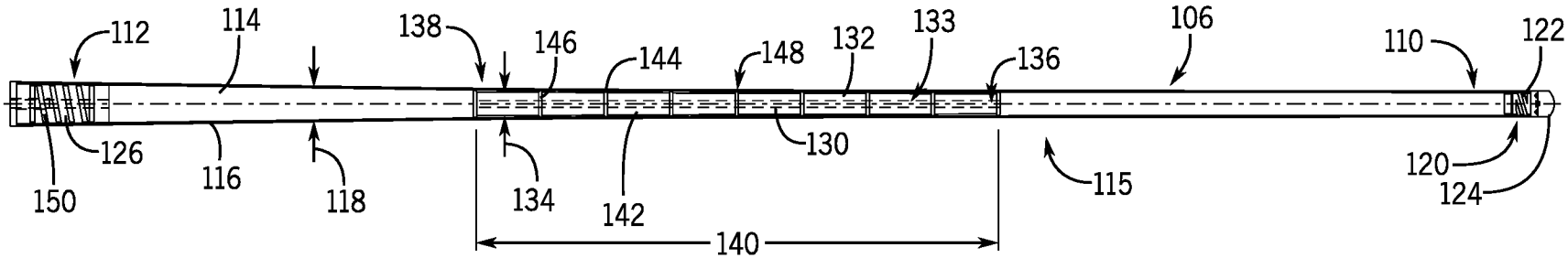
FIG. 2 is a partial sectional view of a shaft section of a cue having a bore therein with a kinetic energy absorbing insert received therein.

Referring now to FIG. 2, a more-detailed view of the shaft section 106 is shown. The shaft section 106 of the cue 100 has a kinetic energy absorbing insert 130 located in the bore 116 of the shaft 114 and contacting the shaft 114 along the bore 116. In one embodiment, the kinetic energy absorbing insert 130 has a body 132 that may be generally cylindrical and has an insert diameter 134. The body 132 has a first end 136 and a second end 138. The first end 136 of the body 132 is located toward the first end 110 of the shaft 114 and the second end 138 of the body 132 is located toward the second end 112 of the shaft 114. However, the body 132 of the insert 130 may be located at any location within the bore 116, including adjacent the first end 110, adjacent the second end 112 or at any location there between. The kinetic energy absorbing insert 130 has an insert length 140 between the first end 136 and the second end 138 of the body 132 that is less than the shaft length 115 of the shaft 114. In one embodiment, the kinetic energy absorbing insert 130 has an insert length 140 of ten inches with the shaft length 115 being greater than ten inches, however, other shaft and insert lengths are possible and are within the scope of the present application.

The body 132 of the kinetic energy absorbing insert 130 has an insert diameter 134 that is less than the bore diameter 118 of the shaft 114 at and near the second end 112, but is greater than the bore diameter 118 at and near the first end 110. The kinetic energy absorbing insert 130 may have an insert bore 142 extending through the kinetic energy absorbing insert 130 from the first end 136 to the second end 138. In one embodiment, the insert diameter 118 is one-eighth inches, however, other bore diameters may be used and are included within the scope of the present application. The kinetic energy absorbing insert 130 also, may have a plurality of circumferential protrusions 144 extending radially outward from the cylindrical body 132. In certain embodiments, the kinetic energy absorbing insert 130 has nine protrusions 144, however fewer than nine or more than nine protrusions are possible and are within the scope of the present application. The protrusions 144 have a protrusion diameter 146 that is equal to or greater than the bore diameter 118 of the shaft 114 at a location approximately equidistant from the first end 110 and the second end 112, such that the protrusions 144 contact the shaft 104 along the bore 116. The cylindrical body 132 of the kinetic energy absorbing insert 130 may taper outwardly from the first end 136 to the second end 138. In one embodiment, the cylindrical body 132 has an insert diameter 134 of approximately 0.40 inches at the first end 136 of the cylindrical body 132 and an insert diameter 134 of approximately 0.45 inches at the second end 138 of the cylindrical body 132; however, other diameters are possible and are within the scope of the present application. As an example, the protrusions 144 of the present disclosure have protrusion diameters 146 span a range between approximately 0.45 inches at the first end to approximately 0.52 inches at the second end, with the protrusion diameter 146 gradually increasing from the first end 136 of the cylindrical body 132 to the second end 138 of the cylindrical body 132 and with the protrusion 144 at the middle of the cylindrical body 132 having a diameter of 0.5 inches; again other protrusion diameters are possible and are within the scope of the present application.

The kinetic energy absorbing insert 130 is made of a structural elastomeric material. In one element, structural elastomeric material of the present embodiment is butyl rubber. Other structural materials that have inherent kinetic energy absorbing properties may also be used, such as SMAC SMACTANE® SP Damping Material. In other embodiments, the kinetic energy absorbing insert 130 is a structural elastomeric material that fills part of or the entire bore 116 in the shaft. In some embodiments, the structural elastomeric material is butyl rubber. In other embodiments, the insert 130 may be wrapped in an energy absorbing material. In certain embodiments the energy absorbing material wrap is SMAC SMACTANE® SP Damping Material. In still other embodiments the insert may be used in conjunction with energy absorbing paint such as Acousti-Coat sound deadening paint available from Hy-Tech Thermal Solutions of Melbourne, Fla. In such embodiments the paint is used to coat the bore 116 of the shaft 114. In still other embodiments, a combination of viscoelastic dampening foam 156 (See FIG. 3) and dampening paint either alone or in conjunction with additional elastomeric material form the kinetic energy absorbing insert 130.

The kinetic energy absorbing insert 130 may be located at approximately the middle 148 of the shaft 114, equidistant between the first end 110 and the second end 112 of the shaft 114, or at any location between the first end 110 and the second end 112 of the shaft 114, including adjacent to the first end 110 or adjacent to the send end 112. The joint insert 126 may have an internally-threaded surface 150 for threadably connecting the shaft section 106 to the butt section 102 and joint collar 104.

Figure 3:
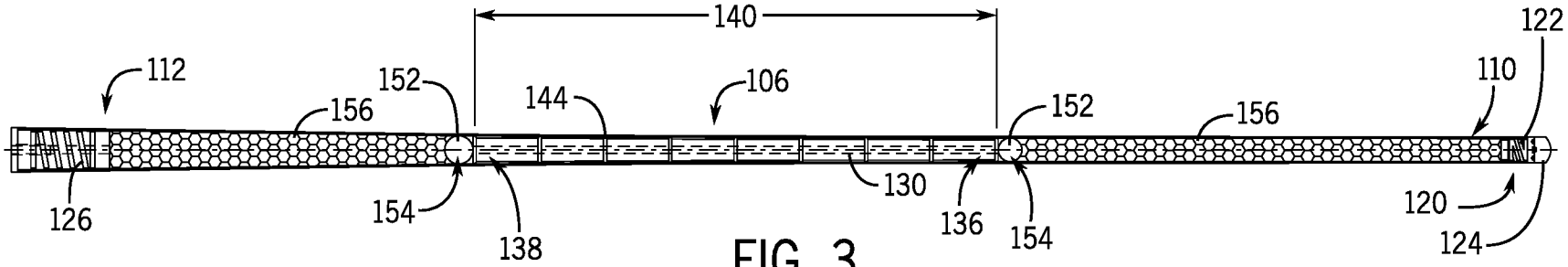
FIG. 3 shows a partial sectional view of a shaft section of a cue that receives a kinetic energy absorbing insert, filler inserts, and viscoelastic foam.

Referring now to FIG. 3, another embodiment of a shaft section 106 is shown. The shaft section 106 may be attached to a butt section 102 and a joint collar 104 in order to form a cue 100 for billiard games. In this embodiment, the shaft section 106 has at least one filler insert 152 for maintaining the longitudinal position of the kinetic energy absorbing insert 130. As shown in FIG. 3, the shaft section 106 has at least one filler insert 152 located in the bore 116 of the shaft 114 between the ferrule 122 and the first end 136 of the kinetic energy absorbing insert 130 and at least one filler insert 152 located in the bore 116 of the shaft 114 between the second end 138 of the kinetic energy absorbing insert 130 and the second end 112 of the shaft 104. In another embodiment, the shaft section 106 of the cue 100 could have at least one filler insert 152 located in the bore 116 of the shaft 114 between the ferrule 122 and the first end 136 of the kinetic energy absorbing insert 130 or at least one filler insert 152 located in the bore 116 of the shaft 114 between the second 138 of the kinetic energy absorbing insert 130 and the joint insert 126. The filler inserts 152 may have a generally spherical shape 152. Additional filler inserts 152 could also be installed in the bore 116 of the shaft 114. Again, the insert 130 may be wrapped in an energy absorbing material. Such as SMAC SMACTANE® SP Damping Material. In still other embodiments the insert may be used in conjunction with energy absorbing paint. In still other embodiments, a combination of viscoelastic dampening foam 156 and dampening paint either alone or in conjunction with additional elastomeric material form the kinetic energy absorbing insert 130.

The cue 100 may further include a viscoelastic dampening foam 156 located in the bore 116 between the ferrule 122 and the first end 136 of the cylindrical body 132 and between the second end 138 of the cylindrical body 132 and the joint insert 126. In other embodiments, the viscoelastic dampening foam 156 is located between the joint insert 126 and a filler insert 152 contacting the second end 138 of the kinetic energy absorbing insert 130 and between the ferrule 122 and a filler insert 152 contacting the first end 136 of the kinetic energy absorbing insert 130.

Figure 4:
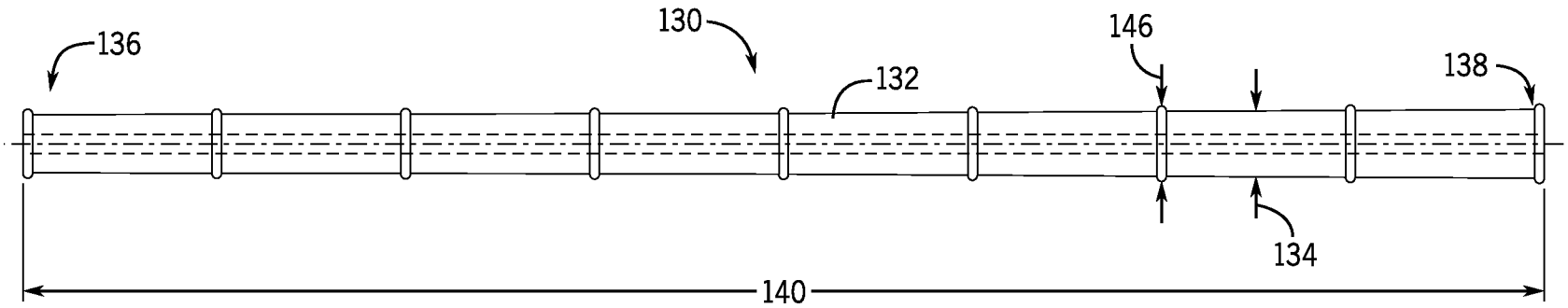
FIG. 4 shows a partial sectional view of a kinetic energy absorbing insert for a cue.
Figure 5:
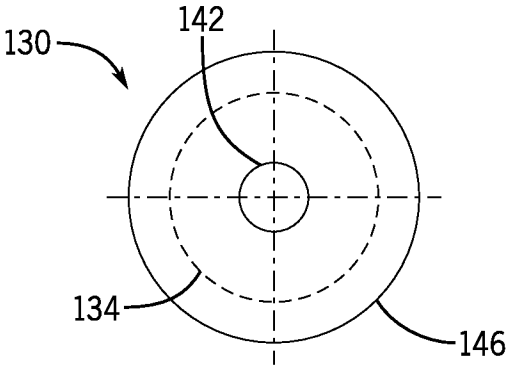
FIG. 5 shows an end view of a kinetic energy absorbing insert for a cue having a plurality of protrusions.

Referring now to FIGS. 4 and 5, a kinetic energy absorbing insert 130 to be received in a bore 116 of a shaft section 106 of a cue 100 used for billiard games is shown. As noted, the kinetic energy absorbing insert 130 may have a generally cylindrical body 132 which has a first end 136 and a second end 138. The kinetic energy absorbing insert 130 may be made of a structural elastomeric material, such as butyl rubber. Other vibration absorbing materials may be used to construct the insert 130. The cylindrical body 132 has an insert diameter 134 that is less than a bore diameter 118 of a bore 114 of the shaft section 106 that is to receive the kinetic energy absorbing insert 130. The kinetic energy absorbing insert 130 may have an insert bore 142 that extends form the first end 136 to the second end 138 of the cylindrical body 132. In certain embodiments the insert body may taper downwardly from the first end 136 to the second end 138.

The kinetic energy absorbing insert 130 also has a plurality of circumferential protrusions 144 extending radially outwardly from the cylindrical body 132. A protrusion 144 is located at the first end 136 of the cylindrical body 132 and another protrusion 144 is located at the second end 138 of the cylindrical body 132. A plurality of protrusions 144 are spaced equally there between. The protrusions 144 may have a protrusion diameter 146 that is equal to or greater than the bore diameter 118 of the shaft section 106 that is to receive the kinetic energy absorbing insert 130, such that the protrusions 144 contact the bore diameter 118.

Figure 6:
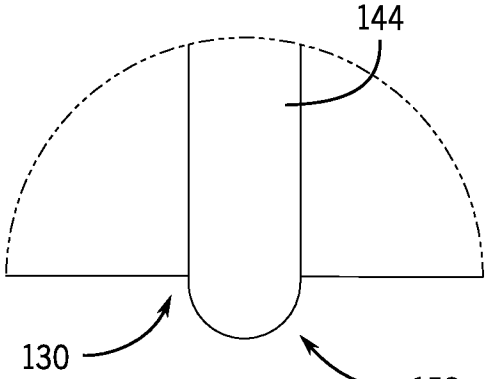
FIG. 6 shows a detailed view of a protrusion of the kinetic energy absorbing insert.

Referring now to FIG. 6, a detailed view of a protrusion 144 of the kinetic energy absorbing insert 130 is shown. In the present embodiment, the protrusion 144 has a rounded shape 158. The protrusions of the present embodiment have a diameter of approximately 0.06 inches, however other diameters are possible and are within the scope of the present application.

In operation, a user may take an existing fully-assembled cue 100 that does not have a kinetic energy absorbing insert 130 of the present disclosure and attach either a shaft section 106 having a kinetic energy absorbing insert 130 of the present disclosure or insert a kinetic energy absorbing insert 130 into a bore 116 to take advantage of the kinetic energy absorbing properties of the shaft section 106 and the kinetic energy absorbing insert 130 of the present disclosure. One way a user could take advantage of the kinetic energy absorbing properties of the shaft section 106 of the present application is to separate an existing shaft section that does not have a kinetic energy absorbing insert 130 from an existing cue 100 by disconnecting the existing shaft section from a joint collar 104 and a butt section 102 by unscrewing the internally threaded surface 150 of the joint insert 126 from the joint collar 104 and butt section 102. The existing shaft section would be replaced with a shaft section 106 of the present disclosure, which would be reattached to the butt section 102 and joint collar 104 by the internally threaded surface 150 of the joint insert 126. Another way a user could take advantage of the kinetic energy absorbing insert 130 of the present disclosure is to disconnect an existing shaft section that does not incorporate a kinetic energy absorbing insert 130 from the joint collar 104 and butt section of the existing cue by unscrewing the internally threaded surface 150 of the joint insert 126. Once the shaft section 106 is separated from the joint collar 104 and butt section 102, the joint insert 126 can be removed, a kinetic energy absorbing insert 130 can be inserted into the bore 116 of the shaft 114, the joint insert 126 can be reinstalled, and the shaft section 106 reassembled to the joint collar 104 and butt section 102. Additionally, a user may purchase a cue 100 having a shaft 106 with a kinetic energy absorbing insert 130 manufactured in place.

In the above description, certain terms have been used for brevity, clarity, and understanding. No unnecessary limitations are to be inferred therefrom beyond the requirement of the prior art because such terms are used for descriptive purposes and are intended to be broadly construed.

What is claimed is:

1. A cue having a butt section, a joint collar, and a shaft section having a tapered cylindrical shape with a first end and second end, the shaft section comprising:

a shaft having a longitudinal bore extending into the shaft, the bore defining a bore diameter;

a tip portion having a ferrule and a tip, the ferrule being located at the first end of the shaft, the tip being removably connected to the ferrule;

a joint insert located at the second end of the shaft for connecting the shaft section to the joint collar and to the butt section;

a kinetic energy absorbing insert located in the bore of the shaft and contacting the shaft; and wherein the kinetic energy absorbing insert is wrapped in an energy absorbing material and the bore is coated with an energy dampening paint.

2. The cue of claim 1, wherein the kinetic energy absorbing insert has a generally cylindrical body having an insert diameter, the cylindrical body having a first end and a second end, the first end being disposed toward the first end of the shaft and the second end being disposed toward the second end of the shaft, wherein the insert length between the first end and the second end of the cylindrical body is less than the length of the shaft.

3. The cue of claim 2, wherein the kinetic energy absorbing insert further comprises:

a generally cylindrical body wherein the insert diameter is less than the bore diameter of the shaft;

a bore extending through the insert from the first end to the second end; and a plurality of circumferential protrusions extending radially outward from the cylindrical body, the protrusions having a protrusion diameter equal to or greater than the bore diameter of the shaft such that the protrusions contact the bore of the shaft.

4. The cue of claim 2, wherein the cylindrical body tapers outwardly from the first end to the second end.

5. The cue of claim 1, wherein the longitudinal bore extends partially into the shaft from the first end to a location spaced from the first end toward the second end.

6. The cue of claim 1, wherein the longitudinal bore extends through the shaft from the first end to the second end.

7. The cue of claim 1, wherein the kinetic energy absorbing insert is comprised of a structural elastomeric material.

8. The cue of claim 7, wherein the structural elastomeric material is butyl rubber.

9. The cue of claim 1, wherein the kinetic energy absorbing insert is disposed at approximately the middle of the shaft equidistant between the first end and the second end of the shaft.

10. The cue of claim 1, wherein the kinetic energy absorbing insert is disposed adjacent the first end of the shaft.

11. The cue of claim 1, wherein the joint insert has an internally threaded surface for threadably connecting the shaft section to the butt section and to the joint collar.

12. The cue of claim 1 further comprising at least one filler insert for maintaining the longitudinal position of the kinetic energy absorbing insert; and wherein the at least one filler insert is disposed in the bore of the shaft between the ferrule and the first end of the kinetic energy absorbing insert.

13. The cue of claim 12, wherein the at least one filler insert is generally spherical.

14. The cue of claim 1 further comprising at least one filler insert for maintaining the longitudinal position of the kinetic energy absorbing insert; and wherein the at least one filler insert is disposed in the bore of the shaft between the second end of the kinetic energy absorbing insert and the joint insert.

15. The cue of claim 2 further comprising a viscoelastic dampening foam located in the bore of the shaft between the first end of the cylindrical body and the ferrule and between the second end of the cylindrical body and the joint insert.

16. The cue of claim 1, wherein the shaft is comprised of carbon fiber material.

17. The cue of claim 1, wherein the shaft is comprised of wood, fiberglass, or aluminum.

18. A shaft section for a cue used for billiards games comprising:

a shaft having a first end and a second end, wherein the shaft section tapers outwardly from the first end to the second end, and a bore extending into the shaft, the bore defining a bore diameter;

a tip portion having a ferrule and a tip, the ferrule being located in the bore of the shaft at the first end of the shaft, the tip being removably connected to the ferrule;

a joint insert located at the second end of the shaft configured to connect the shaft section to a joint collar and to a butt section of a cue;

a kinetic energy absorbing insert located in the bore of the shaft and contacting the bore of the shaft; and a first viscoelastic dampening foam located in the bore of the shaft between the first end of the kinetic energy absorbing insert and the ferrule and a second viscoelastic dampening foam between the second end of the kinetic energy absorbing insert and the joint insert;

wherein the kinetic energy absorbing insert is wrapped in an energy absorbing material and the bore is coated with an energy dampening paint.

19. The shaft section of claim 18, wherein the kinetic energy absorbing insert having a generally cylindrical body with a first end and a second end, an insert length between the first end and the second end being less than the length of the shaft, the generally cylindrical body having an insert diameter less than the bore diameter, and wherein the kinetic energy absorbing insert has a plurality of circumferential protrusions extending radially outwardly from the cylindrical body, the protrusions having a protrusion diameter generally equal to or greater than the bore diameter of the shaft such that the protrusions contact the shaft.

20. The shaft section of claim 19, wherein the kinetic energy absorbing insert has a tapered cylindrical shape that tapers outwardly from the first end to the second end and an insert bore extending through the insert from the first end to the second end of the cylindrical body.

21. The shaft section of claim 18, wherein the bore of the shaft extends partially into the shaft from the first end to a location spaced from the first end toward the second end.

22. The shaft section of claim 18, wherein the bore of the shaft extends through the shaft from the first end to the second end.

23. The shaft section of claim 18, wherein the kinetic energy absorbing insert is comprised of a structural elastomeric material.

24. The shaft section of claim 23, wherein the structural elastomeric material is butyl rubber.

25. The shaft section of claim 18, wherein the shaft is a carbon fiber material.

26. The shaft section of claim 18, wherein the shaft is comprised of wood, fiberglass, or aluminum.

27. The shaft section of claim 18, wherein the kinetic energy absorbing insert is disposed at approximately the middle of the shaft equidistant between the first and second ends of the shaft.

28. The shaft section of claim 18, wherein the kinetic energy absorbing insert is disposed adjacent the first end of the shaft.

29. The shaft section of claim 18, wherein the joint insert has an internally threaded surface for threadably connecting the shaft section to the butt section and to the joint collar.

30. The shaft section of claim 18 further comprising at least one filler insert for maintaining the longitudinal position of the kinetic energy absorbing insert; and wherein the at least one filler insert is disposed in the bore of the shaft between the ferrule and the first end of the kinetic energy absorbing insert.

31. The shaft section of claim 30, wherein the at least one filler insert is generally spherical.

32. The shaft section of claim 18 further comprising at least one filler insert for maintaining the longitudinal position of the kinetic energy absorbing insert; and wherein the at least one filler insert is disposed in the bore of the shaft between the second end of the kinetic energy absorbing insert and the joint insert.

33. The shaft section of claim 18, wherein the kinetic energy absorbing insert has a generally cylindrical body with a first end and a second end; and wherein a viscoelastic dampening foam is located in the bore of the shaft section between the first end of the cylindrical body and the ferrule and between the second end of the cylindrical body and the joint insert.

* * * * *